US009030126B2

(12) United States Patent
Tsao et al.

(10) Patent No.: US 9,030,126 B2
(45) Date of Patent: May 12, 2015

(54) LED DRIVING DEVICE

(71) Applicant: Princeton Technology Corporation, New Taipei (TW)

(72) Inventors: Ming-Yuan Tsao, New Taipei (TW); Mean-Sea Tsay, New Taipei (TW); Shih-Chou Kuo, New Taipei (TW); Chiung-Hung Chen, New Taipei (TW)

(73) Assignee: Princeton Technology Corporation, New Taipei (TW)

( * ) Notice: Subject to any disclaimer, the term of this patent is extended or adjusted under 35 U.S.C. 154(b) by 1 day.

(21) Appl. No.: 14/017,868

(22) Filed: Sep. 4, 2013

(65) Prior Publication Data

US 2014/0232295 A1 Aug. 21, 2014

(30) Foreign Application Priority Data

Feb. 19, 2013 (TW) ..... 102105683 A

(51) Int. Cl.
*H05B 37/02* (2006.01)
*H05B 33/08* (2006.01)

(52) U.S. Cl.
CPC ..... *H05B 33/0848* (2013.01)

(58) Field of Classification Search
USPC ..... 315/291, 292, 192, 224, 308
See application file for complete search history.

(56) References Cited

U.S. PATENT DOCUMENTS

| | | | | |
|---|---|---|---|---|
| 7,675,246 | B2 * | 3/2010 | Chiang et al. | 315/291 |
| 2008/0185975 | A1 * | 8/2008 | Chen et al. | 315/291 |
| 2008/0290933 | A1 * | 11/2008 | Thandi et al. | 327/541 |
| 2009/0066374 | A1 * | 3/2009 | Nagumo | 327/109 |
| 2009/0187925 | A1 * | 7/2009 | Hu et al. | 719/327 |
| 2009/0267652 | A1 * | 10/2009 | Santo et al. | 327/74 |
| 2009/0278521 | A1 * | 11/2009 | Omi et al. | 323/288 |
| 2010/0308739 | A1 * | 12/2010 | Shteynberg et al. | 315/193 |
| 2011/0128303 | A1 * | 6/2011 | Yonemaru et al. | 345/690 |
| 2011/0227490 | A1 * | 9/2011 | Huynh | 315/185 R |
| 2012/0176184 | A1 * | 7/2012 | Santo et al. | 327/538 |
| 2013/0050289 | A1 * | 2/2013 | Kang et al. | 345/690 |
| 2013/0113291 | A1 * | 5/2013 | Recker et al. | 307/80 |
| 2013/0134889 | A1 * | 5/2013 | Chen et al. | 315/193 |
| 2013/0285558 | A1 * | 10/2013 | Recker et al. | 315/153 |
| 2013/0314000 | A1 * | 11/2013 | Murakami | 315/297 |

* cited by examiner

*Primary Examiner* — Thuy Vinh Tran
*Assistant Examiner* — Syed M Kaiser
(74) *Attorney, Agent, or Firm* — Muncy, Geissler, Olds & Lowe, P.C.

(57) ABSTRACT

An LED driving device has a first constant current source circuit and a voltage control circuit. The first constant current source outputs a first constant current to a first node and the first constant current flows into a first LED module disposed between a driving node and the first node; wherein, the first constant current source circuit has a first detection node for generating a first detection signal in response to the voltage level of the first node. The voltage control circuit is coupled to the first detection node, for outputting a control signal in response to the first detection signal to a voltage regulator circuit in order to control and modulate the voltage regulator circuit to output a driving voltage to the driving node.

8 Claims, 14 Drawing Sheets

LED DRIVING DEVICE

CROSS REFERENCE TO RELATED APPLICATIONS

This application claims priority of Taiwan Patent Application No. 102105683, filed on Feb. 19, 2013, the entirety of which is incorporated by reference herein.

BACKGROUND OF THE INVENTION

1. Field of the Invention

The present invention is related to a driving device, and in particular to an LED driving device.

2. Description of the Related Art

A light-emitting diode (LED) driving device is widely applied to the LED driving system. It can be used to detect the working state of the LED and modulate the regulator circuit of the LED driving system to output an appropriate driving voltage for driving the LED.

In conventional LED driving devices, the photo elements are commonly used to detect the voltage across the LED. However, photo elements are hard to be integrated into the integrated circuit (IC). In view of this deficiency, there is a need to present a new LED driving device that is not only able to be integrated into the integrated circuit, but also is able to adjust the driving voltage outputted from the regulator circuit to keep the driving voltage under a low working voltage, without affecting normal functions of the LED. In this way, it avoids additional power consumption and thus saves energy.

BRIEF SUMMARY OF THE INVENTION

A detailed description is given in the following embodiments with reference to the accompanying drawings.

An LED driving device comprises a first constant current source circuit, outputting a first constant current to a first node such that the first constant current flows into a first LED module disposed between a driving node and the first node. The first constant current source circuit has a first detection node for generating a first detection signal in response to the voltage level of the first node. The inventive LED driving device further comprises a voltage control circuit that is coupled to the first detection node and outputs a control signal in response to the first detection signal to a regulator circuit for controlling and modulating the regulator circuit to output a driving voltage to the driving node.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
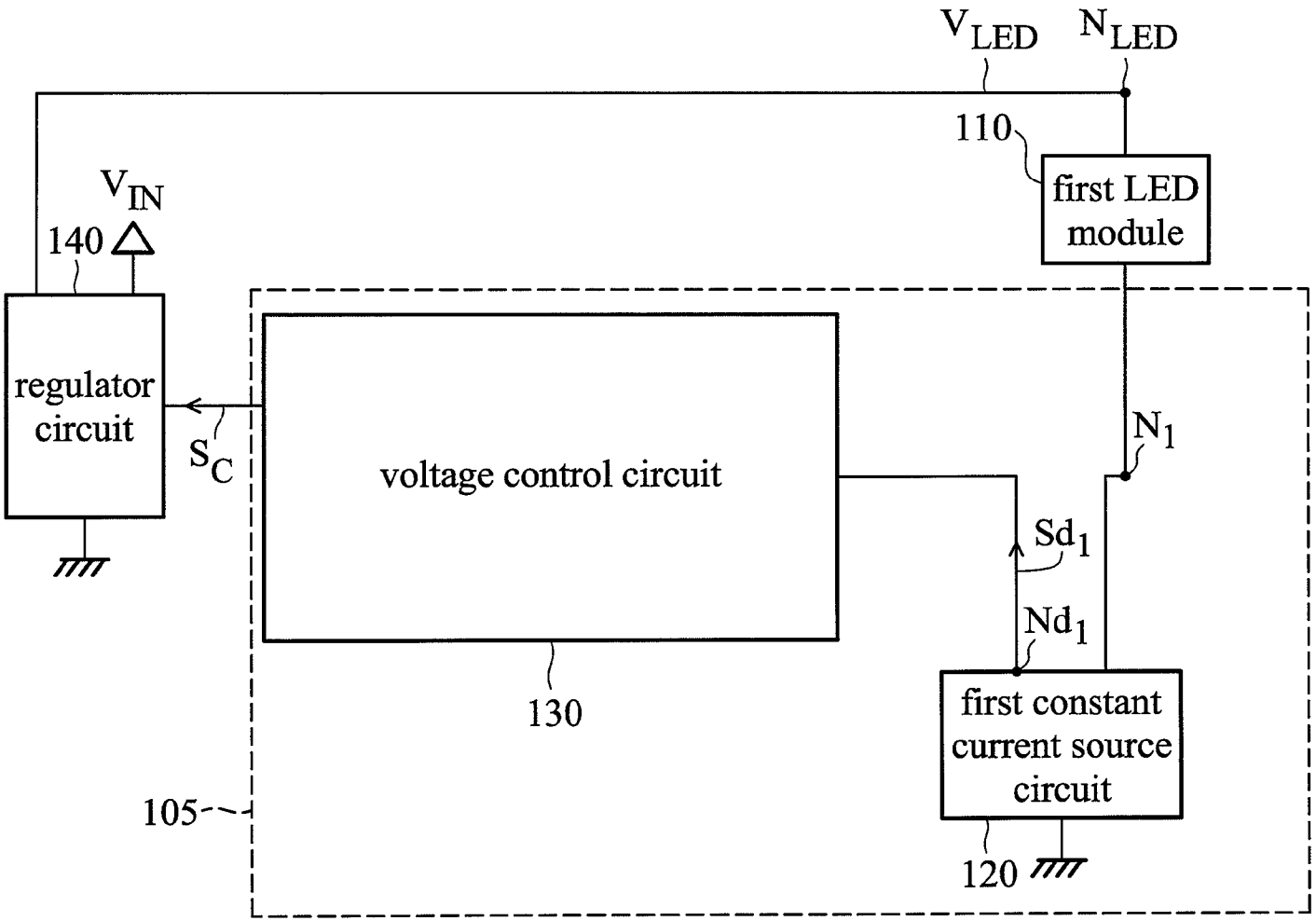
FIG. 1 is a circuit diagram illustrating an LED driving device coupled to a regulator circuit and the LED module, according to the embodiment of the present invention.

FIG. 1 is a circuit diagram illustrating an LED driving device coupled to a regulator circuit and the LED module according to an embodiment of the present invention. As shown in FIG. 1, an LED driving device 105 comprises a first constant current source circuit 120 and a voltage control circuit 130. Additionally, a power source $V_{in}$ is coupled to a regulator circuit 140 for providing electric power. The regulator circuit 140 and the LED driving device 105 are coupled to a reference ground. The first constant current source circuit 120 outputs a first constant current such that the first constant current flows into a first LED module 110 disposed between a driving node $N_{LED}$ and a first node $N_1$. In addition, the first constant current source circuit 120 has a first detection node $Nd_1$. The first detection node $Nd_1$ generates a first detection signal $Sd_1$ in response to the voltage level of the first node $N_1$. The voltage control circuit 130 is coupled to the first detection node $Nd_1$ and outputs a control signal $S_C$ in response to the first detection signal $Sd_1$ to the regulator circuit 140 for controlling and modulating the regulator circuit 140 to output a driving voltage $V_{LED}$ to the driving node $N_{LED}$.

Figure 2:
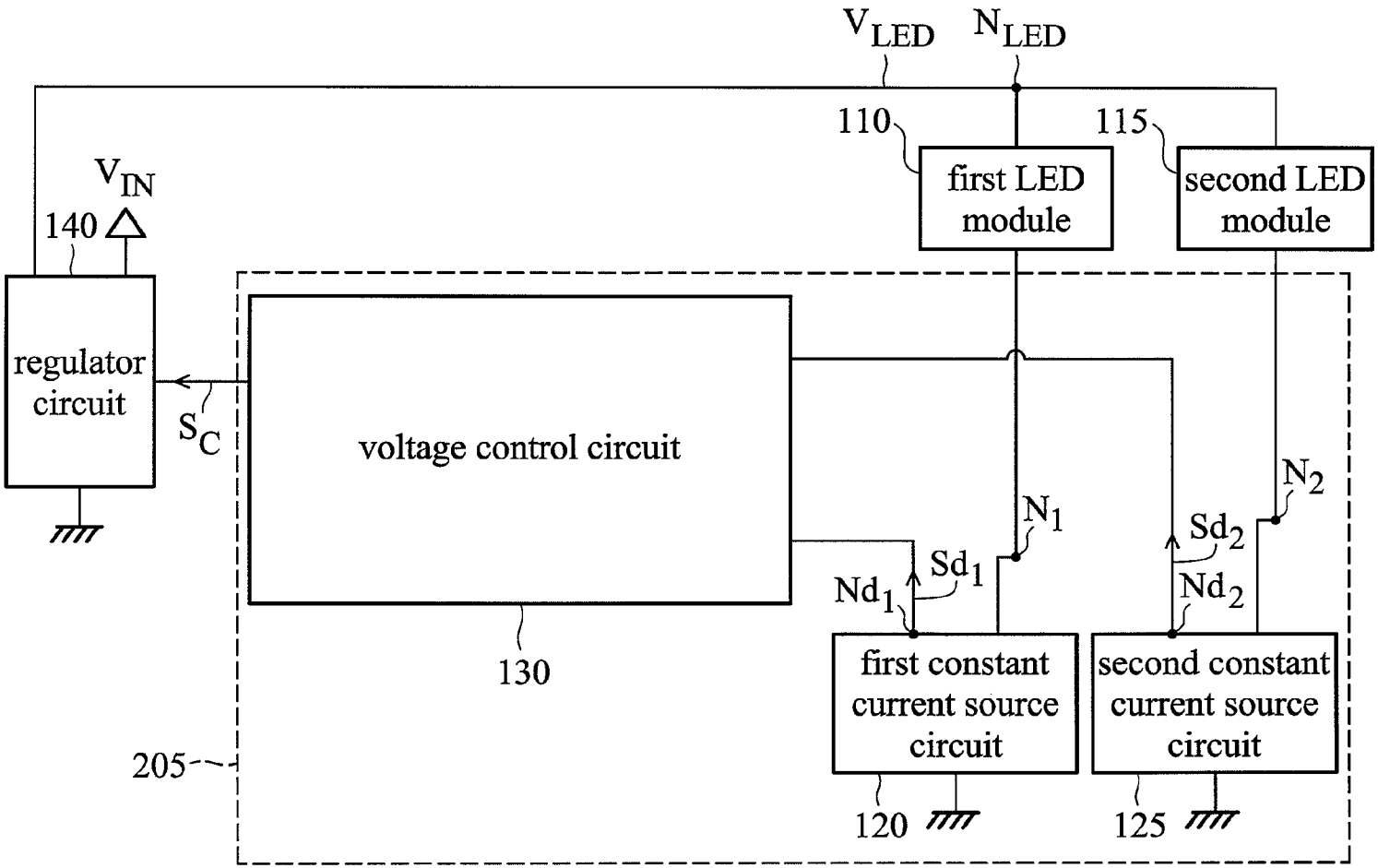
FIG. 2 is a circuit diagram illustrating the LED driving device working with the regulator circuit to drive a plurality of LED modules, according to another embodiment of the present invention.

FIG. 2 is a circuit diagram illustrating the LED driving device working with the regulator circuit to drive a plurality of LED modules according to another embodiment of the present invention. In this case, two driving two LED modules 110 and 115 are taken as an example. Compared with FIG. 1, FIG. 2 further comprises a second constant current source circuit 125 for outputting a second constant current such that the second constant current flows into a second LED module 115 disposed between the driving node $N_{LED}$ and a second node $N_2$. In addition, the second constant current source circuit 125 has a second detection node $Nd_2$ for generating a second detection signal $Sd_2$ in response to the voltage level of the second node $N_2$. In FIG. 2, the voltage control circuit 130 is coupled to the first and second detection nodes $Nd_1$ and $Nd_2$ to simultaneously receive the first and second detection signals $Sd_1$ and $Sd_2$. The voltage control circuit 130 generates the control signal $S_C$ according to the first detection signal $Sd_1$ and the second detection signal $Sd_2$ for controlling the regulator circuit 140 to modulate the driving voltage $V_{LED}$. FIG. 1 and FIG. 2 respectively show the LED driving device being coupled to one set of LED modules and two sets of LED modules. However, the present invention is not limited thereto; the LED driving device of the present invention is able to drive a plurality of LED modules.

Figure 3:
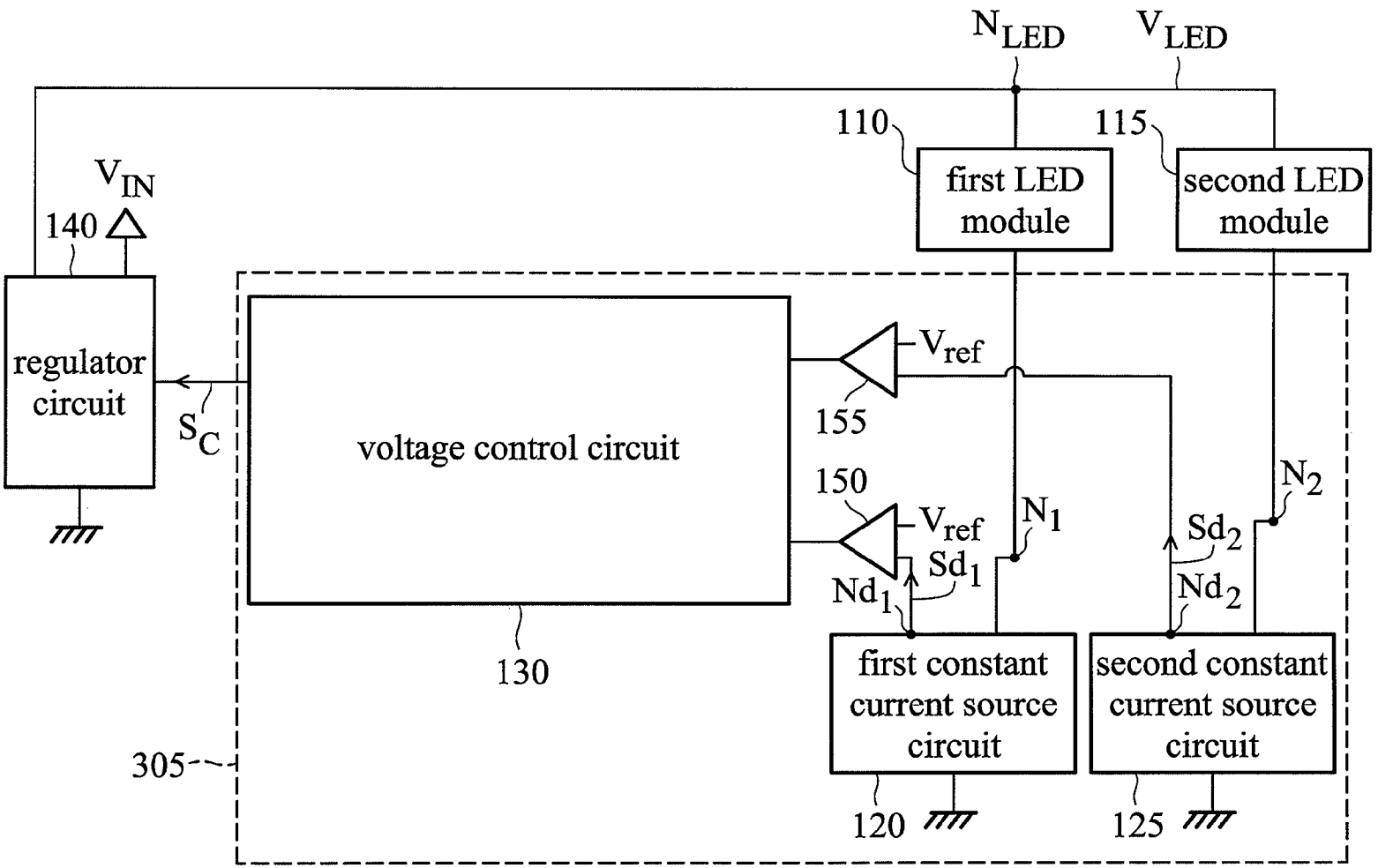
FIG. 3 is a circuit diagram illustrating the LED driving device working with the regulator circuit to drive the plurality of LED modules, according to another yet embodiment of the present invention.

FIG. 3 is a circuit diagram illustrating the LED driving device working with the regulator circuit to drive a plurality of LED modules according to another embodiment of the present invention. In this case, the LED driving device is configured to drive two LED modules 110 and 115. An LED driving device 305 directs the regulator circuit 140 to adjust the driving voltage $V_{LED}$ by the digital voltage control technique. Compared with FIG. 2, the LED driving device 305 further comprises a first comparator 150 and a second comparator 155. The first comparator 150 is disposed between the first detection node $Nd_1$ and the voltage control circuit 130 and thereby comparing the first detection signal $Sd_1$ with a predetermined voltage $V_{ref}$. The second comparator 155 is disposed between the second detection node $Nd_2$ and the voltage control circuit 130 and thereby comparing the second detection signal $Sd_2$ with the predetermined voltage $V_{ref}$. According to the comparison results of the first comparator 150 and the second comparator 155, the voltage control circuit 130 outputs the control signal $S_C$ for controlling the regulator circuit 140 to modulate the driving voltage $V_{LED}$.

Figure 4:
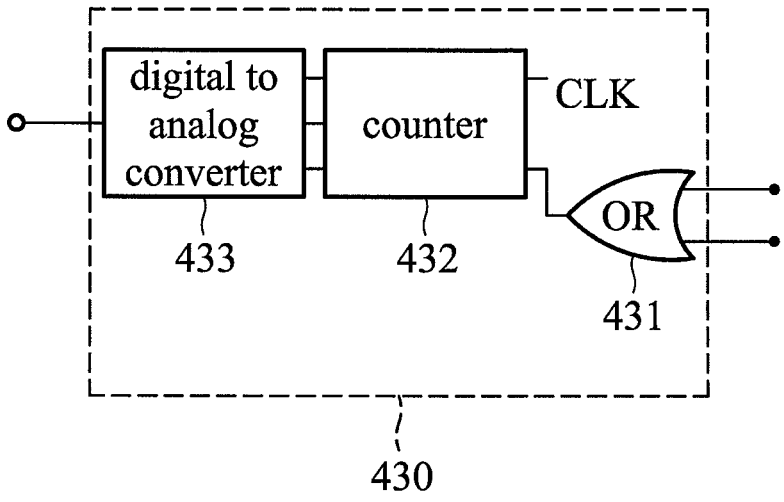
FIG. 4 is an embodiment of the voltage control circuit of the LED driving device in FIG. 3.

FIG. 4 is an embodiment of the voltage control circuit of the LED driving device in FIG. 3. In FIG. 4, a voltage control circuit 430 comprises an OR gate 431, a counter 432, and a digital-to-analog converter 433. The counter 432 is coupled to a clock signal CLK, the output terminal of the OR gate 431, and the digital-to-analog converter 433.

Figure 5A:
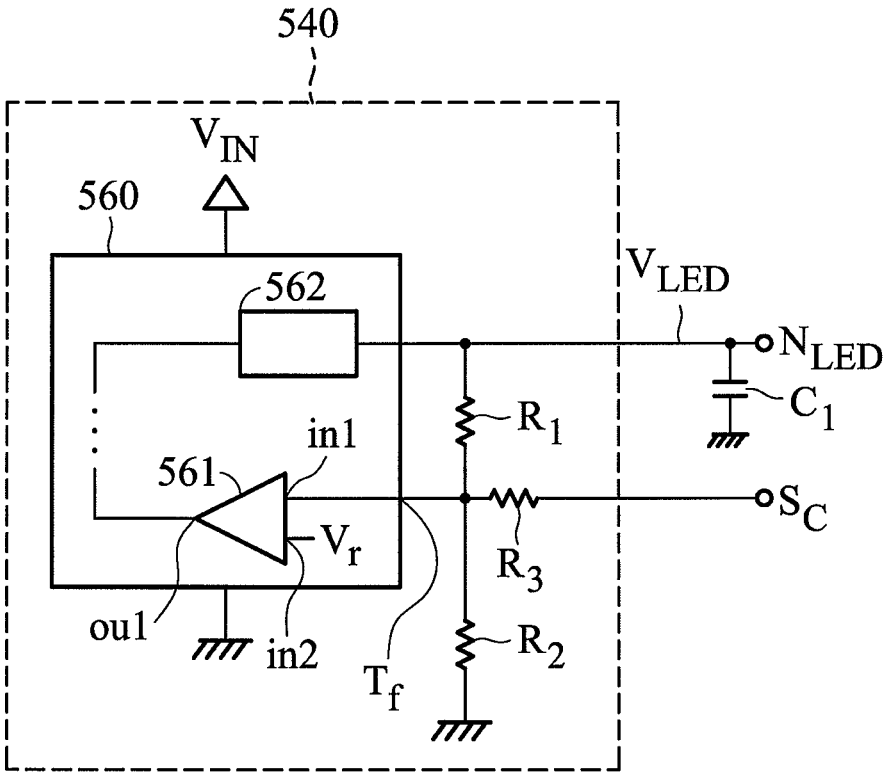
FIG. 5A is an embodiment of the regulator circuit of the aforementioned LED driving devices of the present invention.

FIG. 5A is an embodiment of the regulator circuit of the aforementioned LED driving devices of the present invention. In FIG. 5A, a regulator circuit 540 comprises a regulator 560, a first resistor $R_1$, a second resistor $R_2$, and a third resistor $R_3$. When the regulator circuit 140 in FIG. 3 is implemented with the regulator circuit 540 of FIG. 5A, one terminal of the third resistor $R_3$ is coupled to the control signal $S_C$ outputted from the voltage control circuit 130, and the other terminal of the third resistor $R_3$ is coupled to the connection node between the first resistor $R_1$ and the second resistor $R_2$ and a feedback terminal $T_f$ of a regulator 560, wherein the feedback terminal $T_f$ has a voltage level $V_{FB}$. The serially-connected first resistor $R_1$ and the second resistor $R_2$ are coupled between the driving node $N_{LED}$ and the reference ground. A regulator capacitor $C_1$ is coupled between the driving node $N_{LED}$ and the reference ground. The regulator 560, for example, further comprises an error amplifier 561 and a voltage modulation circuit 562, wherein a first terminal in1 of the error amplifier 561 is coupled to the feedback terminal $T_f$, a second terminal in2 of the error amplifier 561 is coupled to a reference voltage $V_r$, and an output terminal of the error amplifier 561 is coupled to the voltage modulation circuit 562. According to the output of the error amplifier 561, the voltage modulation circuit 562 continuously modulates the driving voltage $V_{LED}$ transmitted to the driving node $N_{LED}$ until the voltage level $V_{FB}$ of the feedback terminal $T_f$ is close to (substantially "equal to") the reference voltage $V_r$.

Figure 5B:
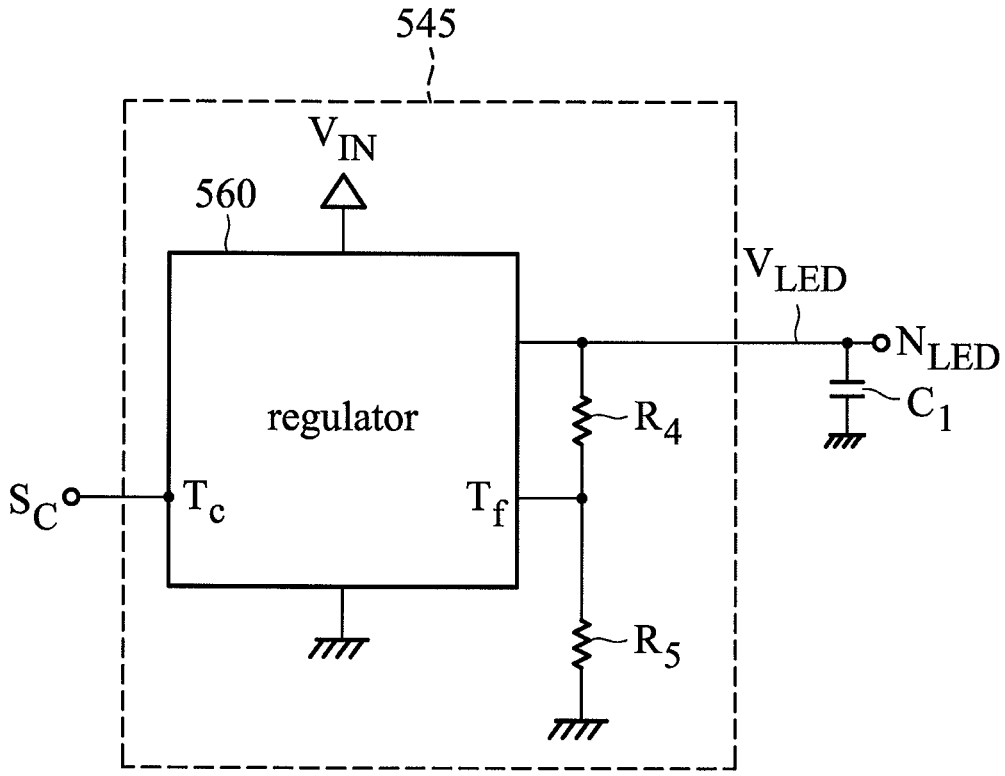
FIG. 5B is another embodiment of the regulator circuit of the aforementioned LED driving devices of the present invention.

FIG. 5B is another embodiment of the regulator circuit of the aforementioned LED driving devices of the present invention. In FIG. 5B, a regulator circuit 545 comprises the regulator 560, a fourth resistor $R_4$ and a fifth resistor $R_5$. When the regulator circuit 140 in FIG. 3 is implemented with the regulator circuit 545 of FIG. 5B, a control input terminal $T_C$ of the regulator 560 is coupled to the control signal $S_C$ outputted from the voltage control circuit 130, and the feedback terminal $T_f$ of the regulator 560 is coupled to the connection node between the fourth resistor $R_4$ and the fifth resistor $R_5$, wherein the serially-connected first resistor $R_4$ and the second resistor $R_5$ are coupled between the driving node $N_{LED}$ and the reference ground. The regulator capacitor $C_1$ is coupled between the driving node $N_{LED}$ and the reference ground. The regulator circuit 545 receives the control signal $S_C$ through the control input terminal $T_C$ and thereby modulating the driving voltage $V_{LED}$ transmitted to the driving node $N_{LED}$. For example, when the control signal $S_C$ received by the control input terminal $T_C$ is at the first voltage level, the regulator circuit 545 continuously modulates the driving voltage $V_{LED}$ until the voltage level of the control signal $S_C$ switches to a second voltage level. It should be noted that the regulator 560 of FIG. 5A and FIG. 5B can be a switching regulator or a linear regulator, but it is not limited thereto.

Figure 6:
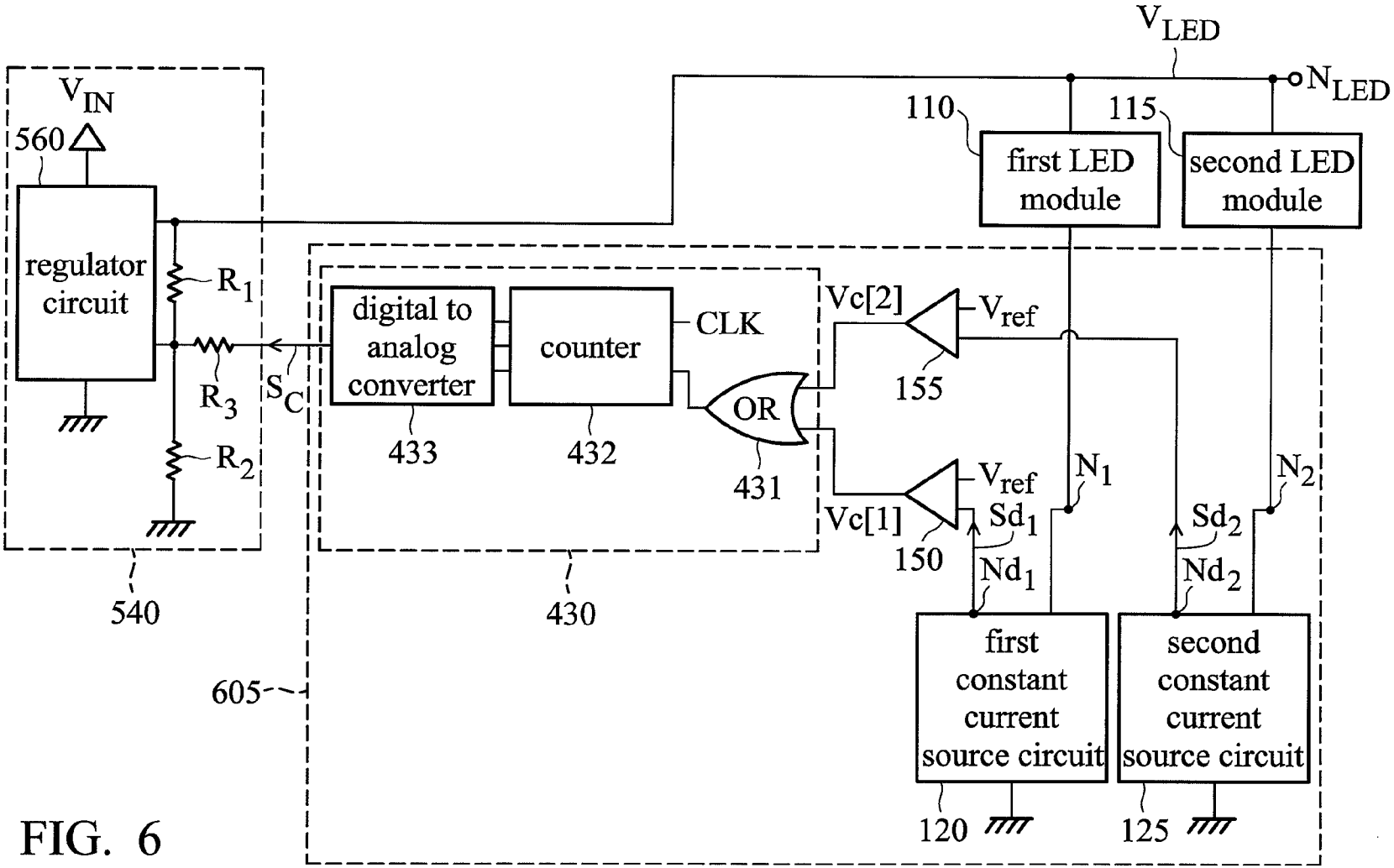
FIG. 6 is a circuit diagram illustrating the LED driving device working with the regulator circuit to drive two LED modules, according to the circuit schematic of the embodiment in FIG. 3.

FIG. 6 is a circuit diagram illustrating the LED driving device working with the regulator circuit 540 to drive two LED modules according to the circuit schematic of the embodiment of FIG. 3. The circuit schematic of FIG. 6 is the same as FIG. 3; the difference is that FIG. 6 further discloses the in-depth circuitry in detail. As shown in FIG. 6, the voltage control circuit 130 of FIG. 3 is replaced with the voltage control circuit 430 of FIG. 4. Referring to FIG. 6 again, the regulator circuit 140 of FIG. 3 is replaced with the regulator circuit 540 of FIG. 5A. The input terminal of the OR gate 431 is coupled to the output terminal of the first comparator 150 and the output terminal of the second comparator 155 to receive a first comparing signal Vc[1] and a second comparing signal Vc[2]. The digital-to-analog converter 433 outputs the control signal $S_C$ to the regulator circuit 540 to control the regulator circuit 540 for modulating the driving voltage $V_{LED}$. The above-mentioned instance is used only for the purpose of exemplification, rather than being used to limit the circuit implementation of the present invention.

Figure 7A:
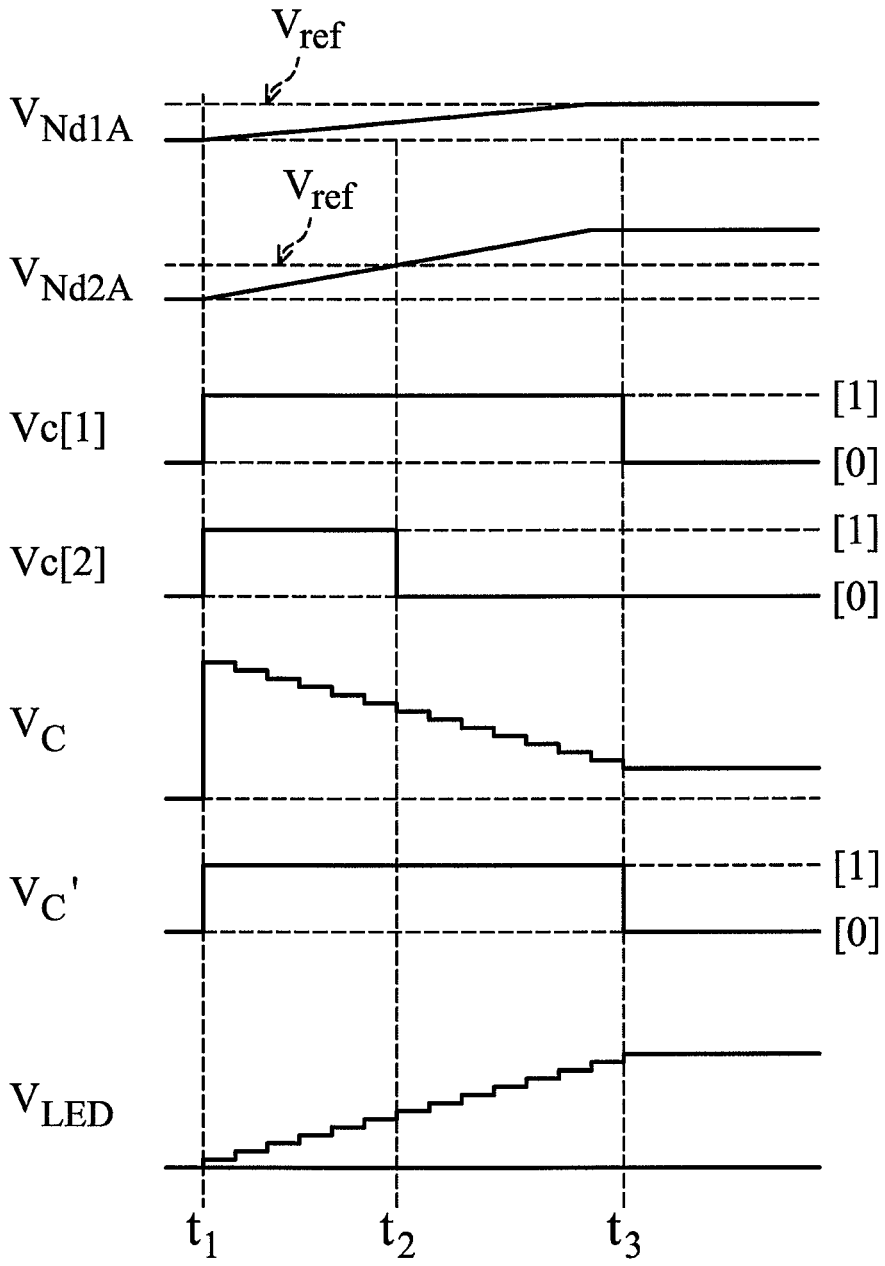
FIG. 7A is a voltage waveform diagram according to the operation of the embodiment in FIG. 6.

FIG. 7A is a voltage waveform diagram according to the operation of the embodiment of FIG. 6. Referring to FIG. 6, FIG. 7A shows that the voltage level $V_{Nd1A}$ of the first detection signal $Sd_1$ and the voltage level of the first node $N_1$ are in positive correlation with each other, and the voltage level $V_{Nd2A}$ of the second detection signal $Sd_2$ and the voltage level of the second node $N_2$ are in positive correlation with each other. That is to say, both of the voltage level $V_{Nd1A}$ of the first detection signal $Sd_1$ and the voltage level $V_{Nd2A}$ of the second detection signal $Sd_2$ are respectively set to change along with the voltage level of the first node $N_1$ and the voltage level of the second node $N_2$ in a positive manner. The first comparator 150 and the second comparator 155 respectively compare the voltage level $V_{Nd1A}$ of the first detection node $Nd_1$ and the voltage level $V_{Nd2A}$ of the second detection node $Nd_2$ with the predetermined voltage $V_{ref}$.

When the regulator circuit 540 powers on at the time $t_1$ (i.e. the power source $V_{in}$ provides electric power to the regulator circuit 540 at the time $t_1$), the voltage level $V_{Nd1A}$ of the first detection signal $Sd_1$ and the voltage level $V_{Nd2A}$ of the second detection signal $Sd_2$ are both lower than the predetermined voltage $V_{ref}$. Thus, the first comparing signal Vc[1] outputted from the first comparator 150 and the second comparing signal Vc[2] outputted from the second comparator 155 both have a high voltage level of logic 「1」.

During the period of $t_1$~$t_2$, the voltage level $V_{Nd1A}$ of the first detection signal $Sd_1$ and the voltage level $V_{Nd2A}$ of the second detection signal $Sd_2$ are still lower than the predetermined voltage $V_{ref}$, so the voltage level of the first comparing signal Vc[1] and the voltage level of the second comparing signal Vc[2] are both at logic 「1」. Under this condition, the OR gate 431 enables the counter 432 to start counting according to the clock signal CLK (not denoted in FIG. 7A), and the digital-to-analog converter 433 changes the voltage level $V_C$ of the control signal $S_C$ according to the counting value of the counter 432. According to the first comparing signal Vc[1] and the second comparing signal Vc[2], the voltage control circuit 430 outputs the control signal $S_C$ with a voltage level $V_C$ being decreased stepwise by every count made by the counter 432. According to the voltage level $V_C$ of the control signal $S_C$, the regulator circuit 540 outputs the driving voltage $V_{LED}$, wherein the voltage level of the driving voltage $V_{LED}$ increases stepwise with the descent of the voltage level $V_C$ of the control signal $S_C$.

At the time $t_2$, the voltage level $V_{Nd2A}$ of the second detection signal $Sd_2$ is higher than the predetermined voltage $V_{ref}$, so the voltage level of the second comparing signal Vc[2] outputted from the second comparator 155 is logic 「0」. However, because the voltage level $V_{Nd1A}$ of the first detection signal $Sd_1$ is still lower than the predetermined voltage $V_{ref}$, the voltage level of the first comparing signal Vc[1] is still logic 「1」 and the OR gate 431 still enables the counter 432 to continue counting. Thus, the voltage level $V_C$ of the control signal $S_C$ continues to decrease stepwise, and the voltage level of the driving voltage $V_{LED}$ continues to increase stepwise.

After the time $t_3$, because the voltage level $V_{Nd1A}$ of the first detection signal $Sd_1$ and the voltage level $V_{Nd2A}$ of the second detection signal $Sd_2$ are both higher than the predetermined voltage $V_{ref}$, the first comparing signal Vc[1] and the second comparing signal Vc[2] are both logic 「0」, such that the OR gate 431 disables the counter 432. In the voltage control circuit 430, because the voltage level $V_C$ of the control signal $S_C$ outputted from the digital-to-analog converter 433 stops decreasing, the driving voltage $V_{LED}$ stops increasing. At this time, the driving voltage $V_{LED}$ is at an low and appropriate working voltage and does not affect the normal functions of the LED.

In FIG. 6, the regulator circuit 540 can also be implemented by the regulator circuit 545 shown in FIG. 5B. The voltage control circuit 430 can also be composed of a simple logic circuit. For example, the OR gate 431 can be used alone to generate the voltage level $V_C'$ of the control signal $S_C$ that is to be provided to the control input terminal $T_C$ of the regulator circuit 545. Then referring to FIG. 7A, during the period of $t_1$~$t_3$, the logic values of the first comparing signal Vc[1] and the second comparing signal Vc[2] are not 「0」 at the same time, so the voltage level $V_C'$ of the control signal $S_C$ outputted from the OR gate 431 is still logic 「1」, such that the driving voltage $V_{LED}$ outputted from the regulator circuit 545 increases stepwise. After the time $t_3$, because the logic values of the first comparing signal Vc[1] and the second comparing signal Vc[2] are both 「0」, the voltage level $V_C'$ of the control signal $S_C$ outputted from the OR gate 431 is logic 「0」, such that the regulator circuit 545 stops modulating the voltage level of the driving voltage $V_{LED}$.

Figure 7B:
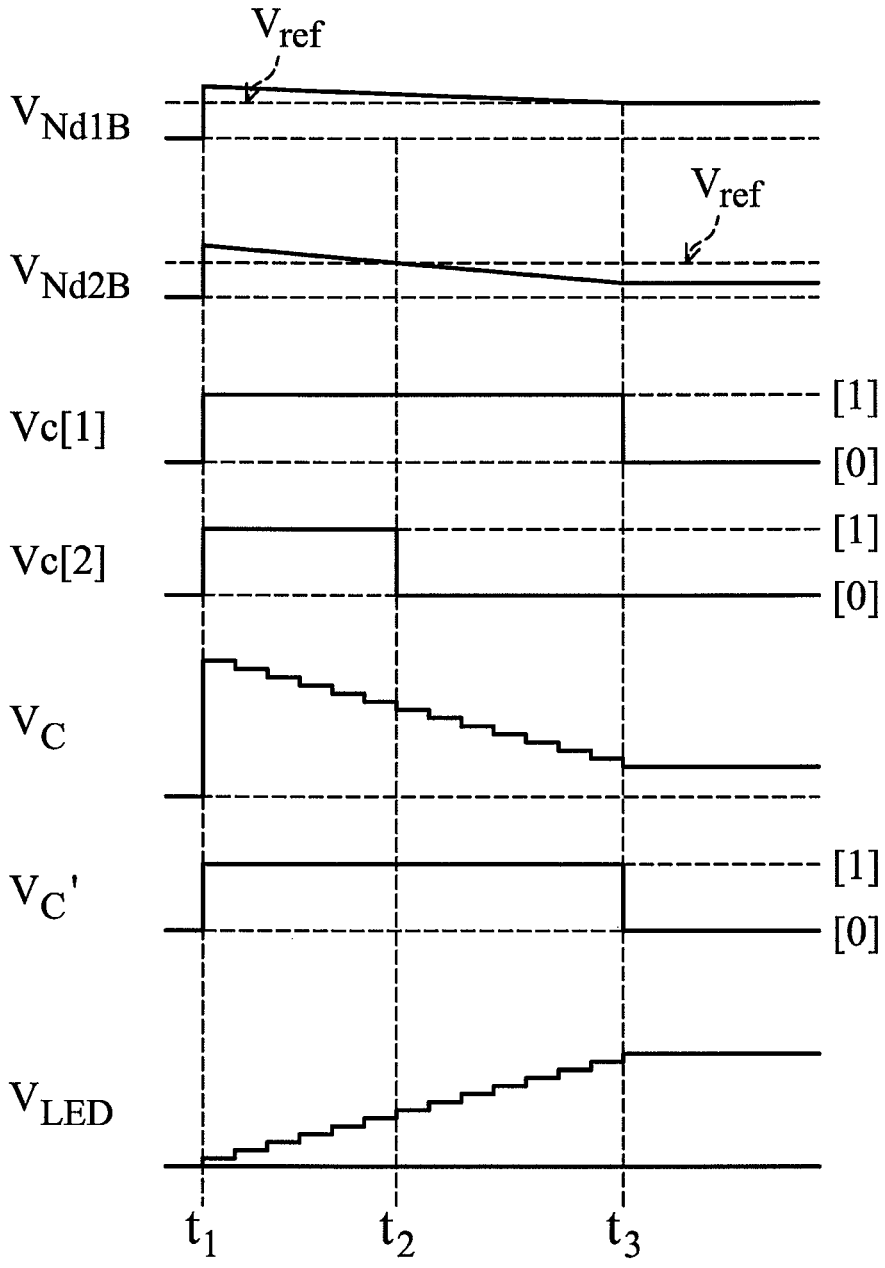
FIG. 7B is a voltage waveform diagram according to the operation of the embodiment in FIG. 6.

FIG. 7B is a voltage waveform diagram according to the operation of the embodiment of FIG. 6. Referring to FIG. 6, FIG. 7B shows that the voltage level $V_{Nd1B}$ of the first detection signal $Sd_1$ and the voltage level of the first node $N_1$ are in negative correlation with each other, and the voltage level $V_{Nd2B}$ of the second detection signal $Sd_2$ and the voltage level of the second node $N_2$ are in negative correlation with each other. That is to say, the voltage level $V_{Nd1B}$ of the first detection signal $Sd_1$ and the voltage level $V_{Nd2B}$ of the second detection signal $Sd_2$ both vary along with the voltage level of the first node $N_1$ and the voltage level of the second node $N_2$ in a negative manner. The first comparator 150 and the second comparator 155 respectively compare the voltage level $V_{Nd1B}$ of the first detection node $Nd_1$ and the voltage level $V_{Nd2B}$ of the second detection node $Nd_2$ with the predetermined voltage $V_{ref}$. In this case, when the voltage level $V_{Nd1B}$ ($V_{Nd2B}$) is lower than the predetermined voltage $V_{ref}$, the logic value of the first comparing signal Vc[1] (the second comparing signal Vc[2]) is 「0」.

During the period of $t_1$~$t_3$, the logic values of the first comparing signal Vc[1] and the second comparing signal Vc[2] are not 「0」 at the same time, so the OR gate 431 enables counter 432 to start counting according to the clock signal CLK (not denoted in FIG. 7B). As mentioned previously, the voltage level $V_C$ of the control signal $S_C$ will decrease stepwise, and the regulator circuit 540 will drive the voltage level of the driving voltage $V_{LED}$ to increase stepwise.

After the time $t_3$, the first comparing signal Vc[1] and the second comparing signal Vc[2] are both logic 「0」, so the regulator circuit 540 stops increasing the driving voltage $V_{LED}$. At this time, the driving voltage $V_{LED}$ is in an low and appropriate working voltage and does not affect the normal functions of the LED.

Figure 8:
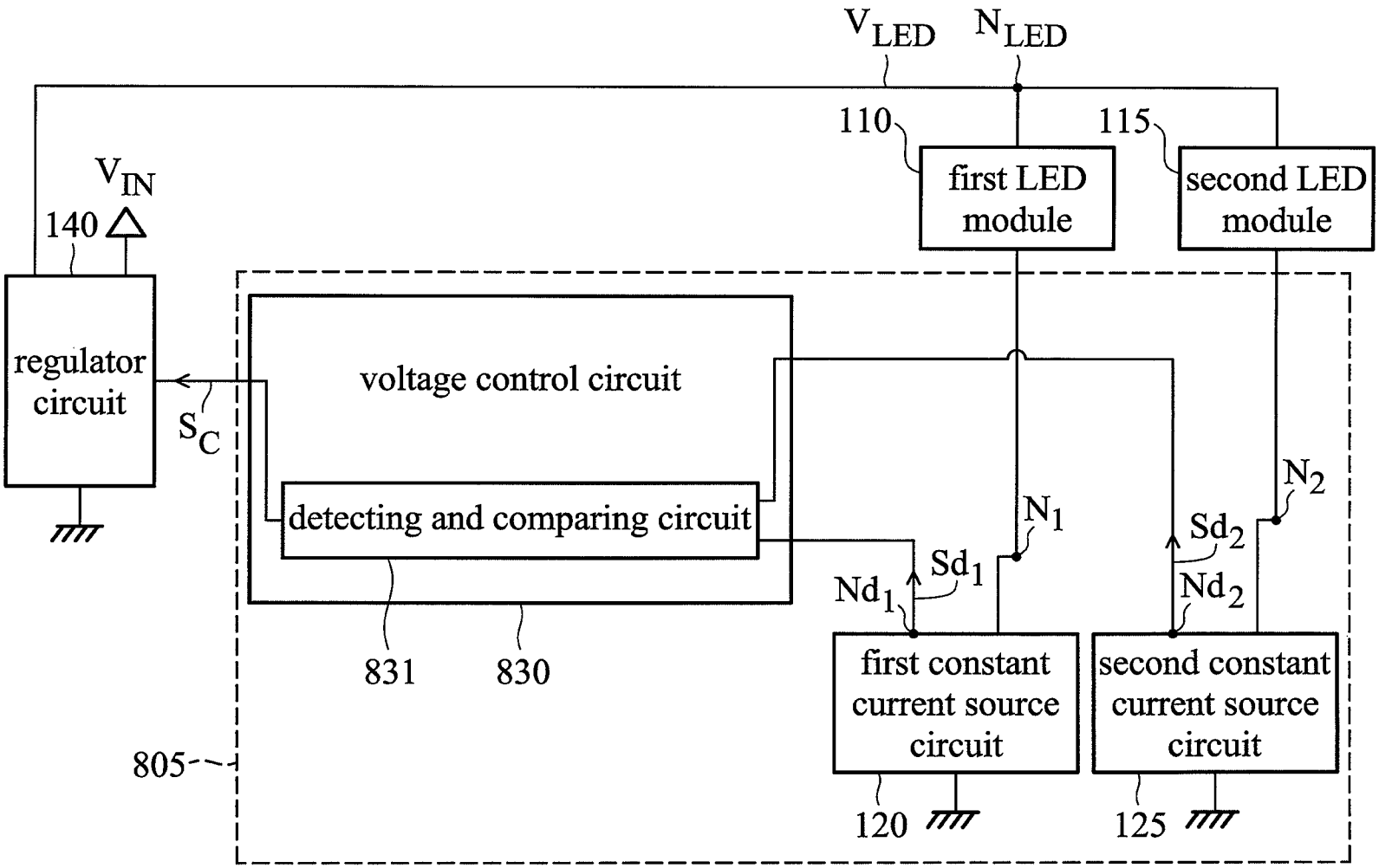
FIG. 8 is a circuit diagram illustrating the LED driving device coupled to two LED modules and the regulator circuit, according to the embodiment of the present invention.

FIG. 8 is a circuit diagram illustrating the LED driving device coupled to two LED modules and the regulator circuit according to an embodiment of the present invention. An LED driving device 805 directs the regulator circuit 140 to adjust the driving voltage $V_{LED}$ by the analog voltage control technique. The circuit schematic in FIG. 8 is similar as FIG. 2; the difference is that FIG. 8 further discloses the in-depth circuitry in detail. In FIG. 8, a voltage control circuit 830 further comprises a detecting and comparing circuit 831. The detecting and comparing circuit 831 receives and compares the first detection signal $Sd_1$ with the second detection signal $Sd_2$ to output the control signal $S_C$ for controlling and modulating the regulator circuit 140 so as to output the driving voltage $V_{LED}$ to the driving node $N_{LED}$.

Figure 9A:
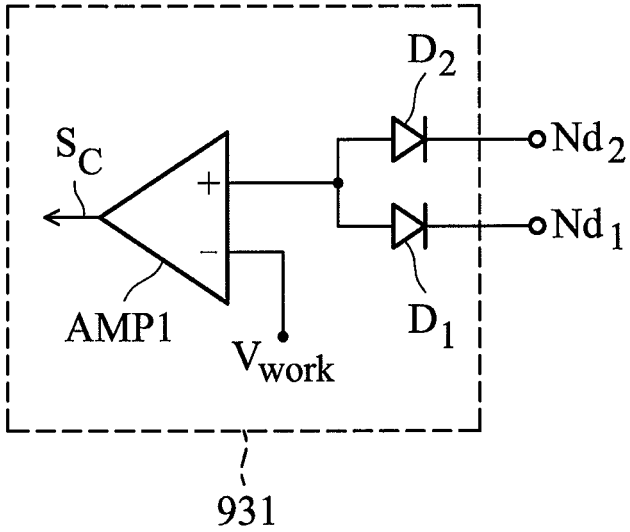
FIG. 9A shows an embodiment of the detecting and comparing circuit in FIG. 8.

FIG. 9A is an embodiment of the detecting and comparing circuit 831 of FIG. 8. In FIG. 9A, a detecting and comparing circuit 931 comprises an operational amplifier AMP1, a first diode $D_1$ and a second diode $D_2$. The anode of the first diode $D_1$ and the anode of the second diode $D_2$ are both coupled to the positive input terminal (+) of the operational amplifier AMP1, and a working voltage $V_{work}$ is coupled to the negative terminal (−) of the operational amplifier AMP1. When the voltage level of the first detection signal $Sd_1$ and the voltage level of the first node $N_1$ are in positive correlation with each other, and the voltage level of the second detection signal $Sd_2$ and the voltage level of the second node $N_2$ are in positive correlation with each other, then the detecting and comparing circuit 831 of FIG. 8 can also be implemented by the circuitry of the detecting and comparing circuit 931 shown in FIG. 9A. In the detecting and comparing circuit 931, the cathode of the first diode $D_1$ and the cathode of the second diode $D_2$ are respectively coupled to the first detection node $Nd_1$ and the second detection node $Nd_2$ to respectively receive the first detection signal $Sd_1$ and the second detection signal $Sd_2$. Then the operational amplifier AMP1 outputs the control signal $S_C$. Based on the circuit schematic of the detecting and comparing circuit 931, the lower one of the first detection signal $Sd_1$ and the second detection signal $Sd_2$ is applied to the positive input terminal (+) of the operational amplifier AMP1 so as to determine the voltage level $V_C$ of the control signal $S_C$.

Figure 9B:
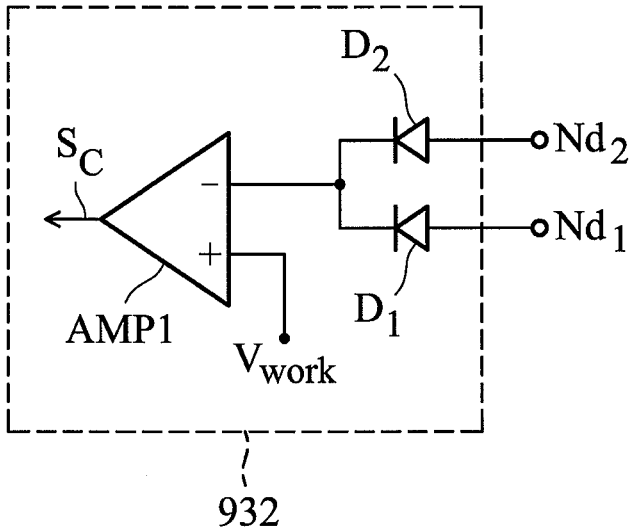
FIG. 9B is another embodiment of the detecting and comparing circuit 831 in FIG. 8.

FIG. 9B is another embodiment of the detecting and comparing circuit 831 of FIG. 8. In FIG. 9B, a detecting and comparing circuit 932 comprises the operational amplifier AMP1, the first diode $D_1$ and the second diode $D_2$. The cathode of the first diode $D_1$ and the cathode of the second diode $D_2$ are both coupled to the negative input terminal (−) of the operational amplifier AMP1, and the working voltage $V_{work}$ is coupled to the positive input terminal (+) of the operational amplifier AMP1. When the voltage level of the first detection signal $Sd_1$ and the voltage level of the first node $N_1$ are in negative correlation with each other and the voltage level of the second detection signal $Sd_2$ and the voltage level of the second node $N_2$ are negative correlation with each other, then the detecting and comparing circuit 831 of FIG. 8 can also be implemented by the circuitry of the detecting and comparing circuit 932 shown in FIG. 9B. In the detection compare circuit 932, the anode of the first diode $D_1$ and the anode of the second diode $D_2$ are respectively coupled to the first detection node $Nd_1$ and the second detection node $Nd_2$ to respectively receive the first detection signal $Sd_1$ and the second detection signal $Sd_2$. Then the operational amplifier AMP1 outputs the control signal $S_C$. Based on the circuit schematic of the detecting and comparing circuit 932, the higher one of the first detection signal $Sd_1$ and the second detection signal $Sd_2$ is applied to the negative input terminal (−) of the operational amplifier AMP1 so as to determine the voltage level $V_C$ of the control signal $S_C$.

Figure 10A:
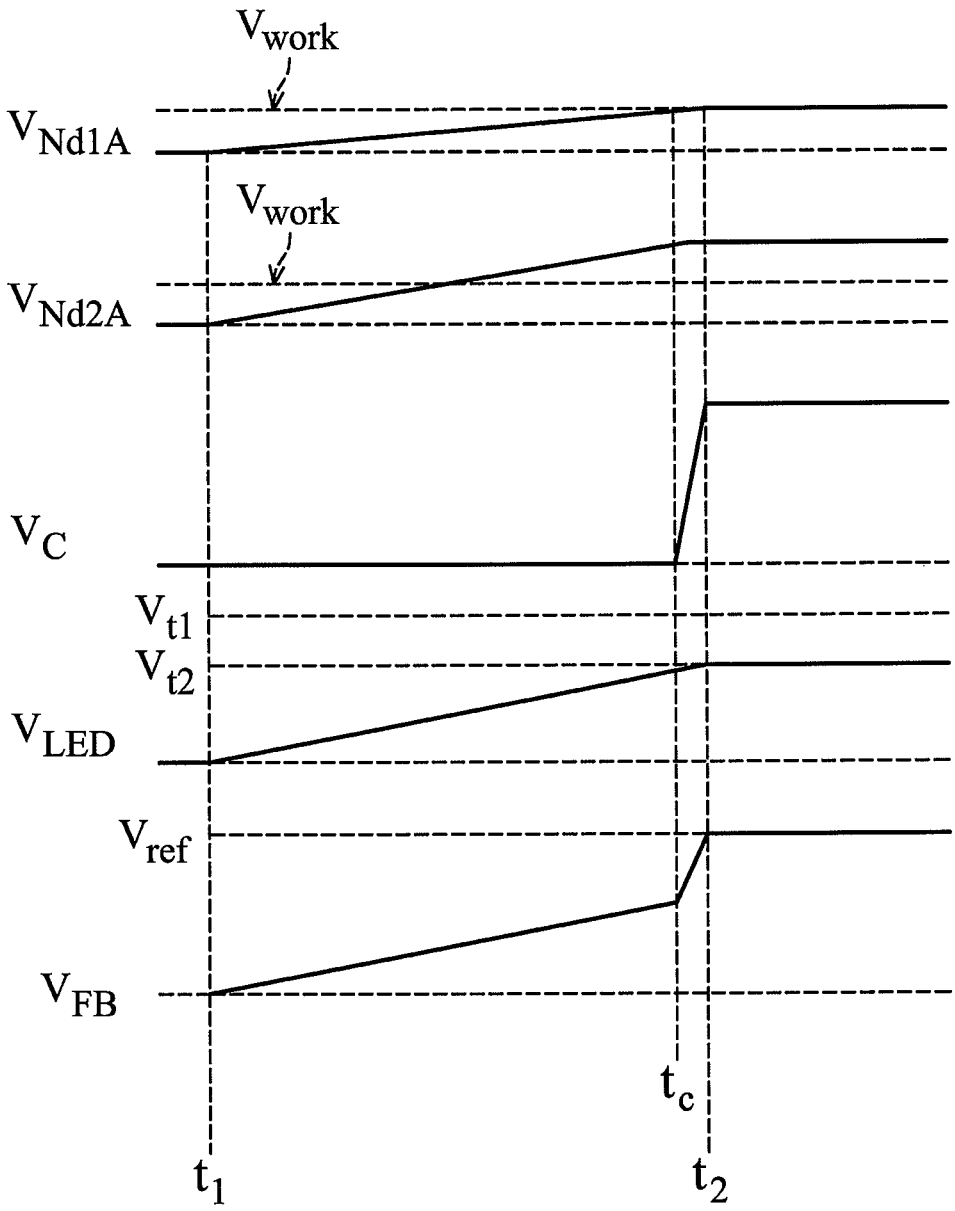
FIG. 10A is a voltage waveform diagram sketched when the LED driving device of the embodiment of FIG. 8 is operating.

FIG. 10A is a voltage waveform diagram sketched when the LED driving device of the embodiment of FIG. 8 is operating. In FIG. 10A, the voltage level $V_{Nd1A}$ of the first detection signal $Sd_1$ and the voltage level of the first node $N_1$ are in positive correlation with each other, and the voltage level $V_{Nd2A}$ of the second detection signal $Sd_2$ and the voltage level of the second node $N_2$ are in positive correlation with each other, so the detecting and comparing circuit 831 of FIG. 8 is implemented with the circuitry of the detecting and comparing circuit 931 of FIG. 9A. In this embodiment, the regulator circuit 140 of FIG. 8 can also be implemented by the regulator circuit 540 of FIG. 5A.

When the regulator circuit 540 powers on at the time $t_1$ (i.e. the power source $V_{in}$ provides electric power to the regulator circuit 540 at the time $t_1$), the voltage level of the first node $N_1$ and the voltage level of the second node $N_2$ start increasing and therefore the voltage level $V_{Nd1A}$ of the first detection signal $Sd_1$ and the voltage level $V_{Nd2A}$ of the second detection signal $Sd_2$ also increase. In FIG. 10A, during the period of $t_1$~$t_2$, because the voltage level $V_{Nd1A}$ of the first detection signal $Sd_1$ is lower than the voltage level $V_{Nd2A}$ of the second detection signal $Sd_2$, the first detection signal $Sd_1$ is applied to the positive input terminal (+) of the operational amplifier AMP1. The operational amplifier AMP1 amplifies the voltage difference between the first detection signal $Sd_1$ and the working voltage $V_{work}$ and thereby outputting the voltage level $V_C$ of the control signal $S_C$.

Based on the descriptions of FIG. 5, the regulator circuit 540 changes the driving voltage $V_{LED}$ according to the variations of the voltage level $V_C$ of the control signal $S_C$, wherein the mathematical formula among the control signal $S_C$, the driving voltage $V_{LED}$, and the voltage level $V_{FB}$ of the feedback terminal $T_f$ is given as follows:

$$V_{FB} = \frac{R_2 // R_3}{R_1 + R_2 // R_3} \times V_{LED} + \frac{R_1 // R_2}{R_3 + R_1 // R_2} \times Vc. \quad (1)$$

During the period of $t_1$~$t_c$, the regulator circuit 540 charges the regulator capacitor $C_1$, so the driving voltage $V_{LED}$ gradually increases and the voltage level $V_{Nd1A}$ of the first detection signal $Sd_1$ and the voltage level $V_{Nd2A}$ of the second detection signal $Sd_2$ increase as well, wherein the driving voltage $V_{LED}$ and the voltage level $V_{Nd1A}$, $V_{Nd2A}$ have a positive correlation with each other. The voltage level of the positive input terminal (+) of the operational amplifier AMP1 is the voltage level $V_{Nd1A}$ of the first detection signal $Sd_1$, which is lower than the working voltage $V_{work}$. The operational amplifier AMP1 amplifies the voltage difference between the positive input terminal (+) and the negative input terminal (−). The voltage level $V_C$ of the control signal $S_C$ outputted from the operational amplifier AMP1 exceeds the output range (Vin~0V) of the operational amplifier AMP1, so the voltage level $V_C$ of the control signal $S_C$ is 0V (the output saturation voltage level of the operational amplifier AMP1). During the period of $t_1$~$t_c$, because the voltage level $V_{FB}$ of the feedback terminal $T_f$ is lower than the reference voltage $V_r$, the regulator circuit 540 continuously increases the driving voltage $V_{LED}$ such that the driving voltage $V_{LED}$ approximates the voltage level $V_{t1}$ of a target driving voltage.

During the period of $t_c$~$t_2$, the voltage level $V_{Nd1A}$ of the first detection signal $Sd_1$ approximates the working voltage $V_{work}$, and the voltage level $V_C$ of the control signal $S_C$ outputted from the operational amplifier AMP1 does not exceed the output range of the operational amplifier AMP1 (i.e. the voltage level $V_C$ of the control signal $S_C$ outputted from the operational amplifier AMP1 deviates the saturation region). Therefore, the voltage level $V_C$ of the control signal $S_C$ starts increasing such that the voltage level $V_{FB}$ of the feedback terminal $T_f$ varies along with the voltage level $V_C$ of the control signal $S_C$ (referring to the equation (1) and the voltage level $V_{FB}$ in FIG. 10A). The voltage level $V_{FB}$ of the feedback terminal $T_f$ is equal to the reference voltage $V_r$ at the time $t_2$ beforehand, so the regulator circuit 540 stops increasing the driving voltage $V_{LED}$. Due to the variations of the voltage level $V_C$ of the control signal $S_C$, the voltage level of the target driving voltage changes from $V_{t1}$ to $V_{t2}$. At this time, the driving voltage $V_{LED}$ is equal to the voltage level $V_{t2}$ of the target driving voltage, so the driving voltage $V_{LED}$ is stable. Because the driving voltage $V_{LED}$ is stable, the voltage level $V_{Nd1A}$ of the first detection signal $Sd_1$ and the voltage level $V_{Nd2A}$ of the second detection signal $Sd_2$ stop increasing, such that the voltage level $V_C$ of the control signal $S_C$ stops increasing.

Figure 10B:
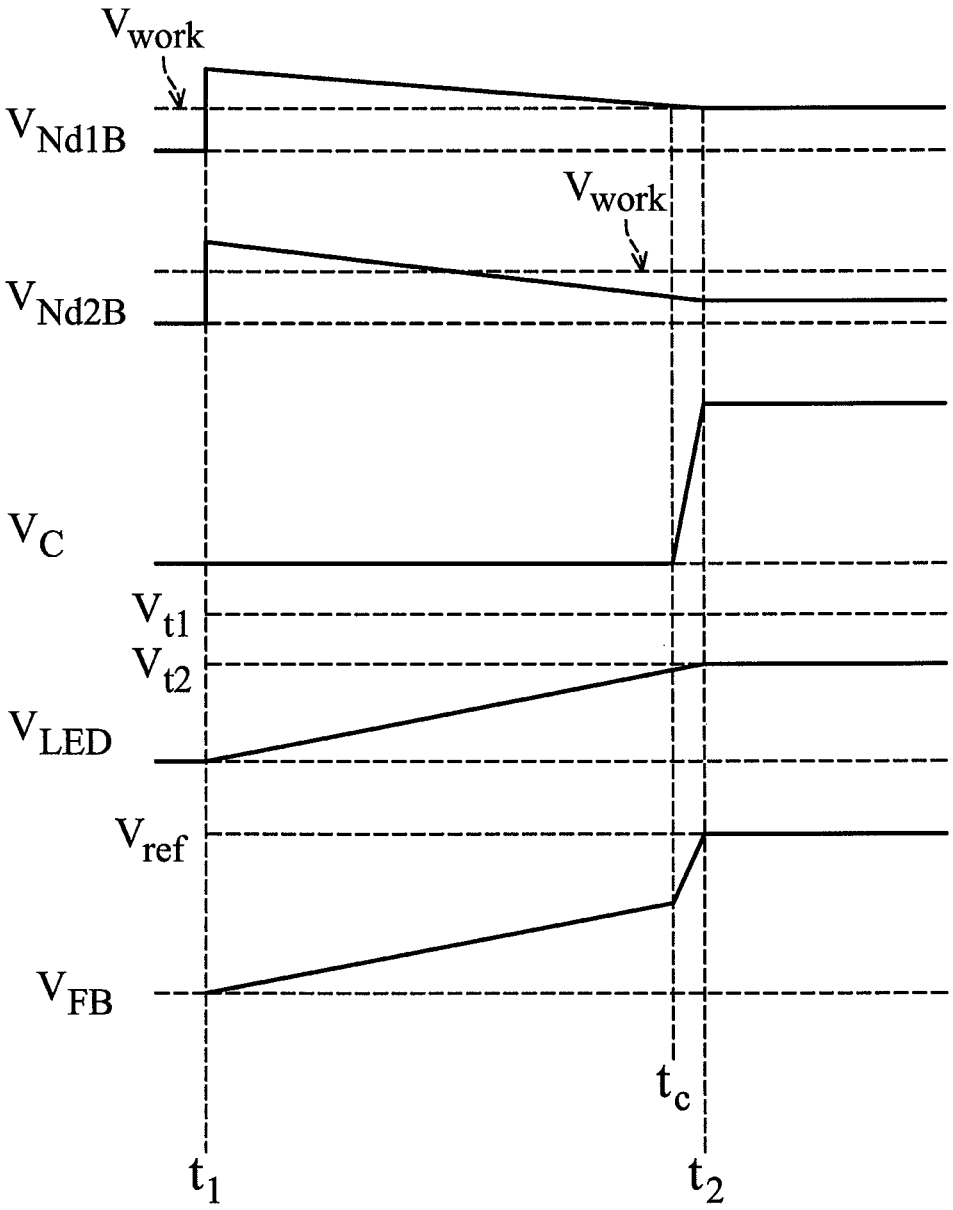
FIG. 10B is another voltage waveform diagram sketched when the LED driving device of the embodiment of FIG. 8 is operating.

FIG. 10B is another voltage waveform diagram sketched when the LED driving device of the embodiment of FIG. 8 is operating. In FIG. 10B, the voltage level $V_{Nd1B}$ of the first detection signal $Sd_1$ and the voltage level of the first node $N_1$ are in negative correlation with each other, and the voltage level $V_{Nd2B}$ of the second detection signal $Sd_2$ and the voltage level of the second node $N_2$ are in negative correlation with each other, so the detecting and comparing circuit 831 of FIG. 8 is implemented with the circuitry of the detecting and comparing circuit 932 of FIG. 9B. In this embodiment, the regulator circuit 140 of FIG. 8 can also be implemented by the circuitry of the regulator circuit 540 of FIG. 5A. When the regulator circuit 540 powers on at the time $t_1$ (i.e. the power source $V_{in}$ provides electric power to the regulator circuit 540 at the time $t_1$), the voltage level of the first node $N_1$ and the voltage level of the second node $N_2$ start increasing, and the voltage level $V_{Nd1B}$ of the first detection signal $Sd_1$ and the voltage level $V_{Nd2B}$ of the second detection signal $Sd_2$ start decreasing. In FIG. 10B, during the period of $t_1$~$t_2$, the voltage level $V_{Nd1B}$ of the first detection signal $Sd_1$ is higher than the voltage level $V_{Nd2B}$ of the second detection signal $Sd_2$, so the first detection signal $Sd_1$ is applied to the negative input terminal (−) of the operational amplifier AMP1. The operational amplifier AMP1 amplifies the voltage difference between the first detection signal $Sd_1$ and the working voltage $V_{work}$ to output the voltage level $V_C$ of the control signal $S_C$.

Likewise, as mentioned in FIG. 5A, the regulator circuit 540 changes the driving voltage $V_{LED}$ according to the variations of the voltage level $V_C$ of the control signal $S_C$. During the period of $t_1$~$t_c$, the voltage level $V_{FB}$ of the feedback terminal $T_f$ is lower than the reference voltage $V_r$, so the regulator circuit 540 continuously increases the driving voltage $V_{LED}$. At the time $t_2$, the voltage level $V_{FB}$ of the feedback terminal $T_f$ is equal to the reference voltage $V_r$, so the regulator 560 stops increasing the driving voltage $V_{LED}$.

Figure 11:
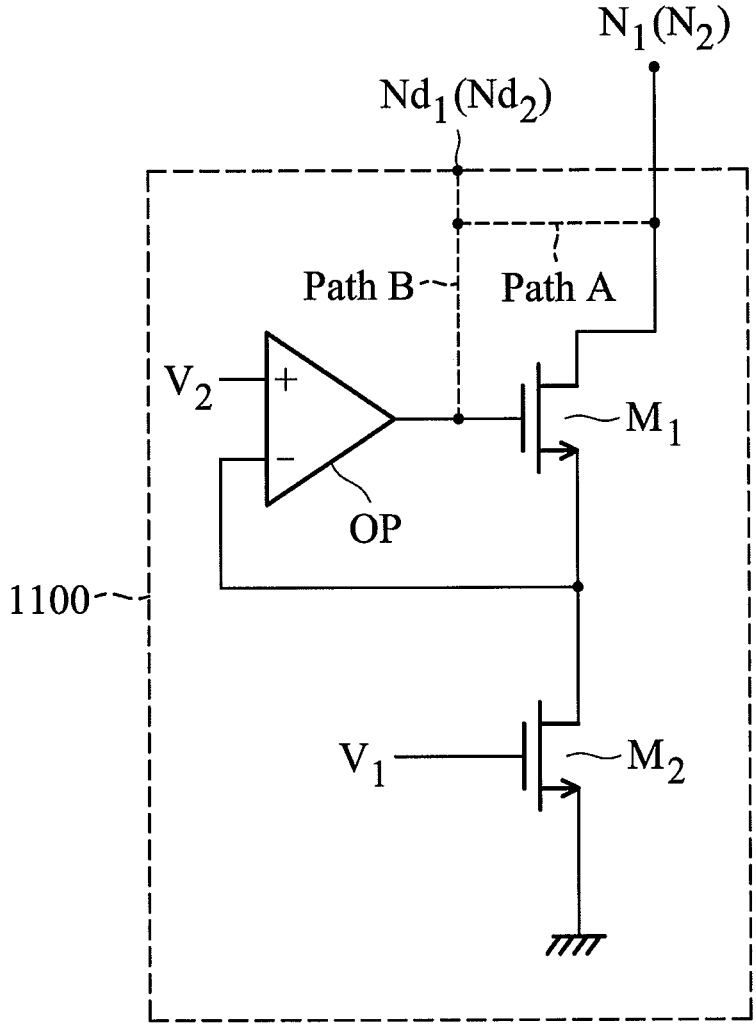
FIG. 11 is a circuit diagram illustrating the constant current source circuit, according to an embodiment of the present invention.

FIG. 11 is a circuit diagram illustrating the constant current circuit according to an embodiment of the present invention. The first constant current source circuit 120 shown in FIGS. 1~3, 6, and 8, the second constant current source circuit 125 shown in FIGS. 2·3, 6, and 8, and the plurality of the constant current circuits applied to the LED driving device all can be implemented with a constant current source circuit 1100 shown in FIG. 11.

The constant current source circuit 1100 comprises a first transistor $M_1$, a second transistor $M_2$, and a first operational amplifier OP. In this embodiment, the first transistor $M_1$ and the second transistor $M_2$ are NMOS transistors, but it is not limited thereto. The first transistor $M_1$ and the second transistor $M_2$ are connected in series and the source electrode of the second transistor $M_2$ is coupled to the reference ground, wherein the control terminal of the second transistor $M_2$ is coupled to a first voltage $V_1$. A first input terminal of the first operational amplifier OP (the positive input terminal of the first operational amplifier OP) is coupled to a second voltage $V_2$, a second input terminal of the first operational amplifier OP (the negative input terminal of the first operational amplifier OP) is coupled to the connection node between the first transistor $M_1$ and the second transistor $M_2$, and an output terminal of the first operational amplifier OP is coupled to the control terminal of the first transistor $M_1$. In addition, the constant current source circuit 1100 comprises a detection node.

This embodiment takes the first constant current source circuit 120 for instance. When the first constant current source circuit 120 is implemented with the constant current source circuit 1100, the drain electrode of the first transistor $M_1$ is coupled to the first node $N_1$ and the detection node serves as the first detection node $Nd_1$. If the first detection node $Nd_1$ is connected to the first node $N_1$ through a first path (Path A), the first detection signal $Sd_1$ measured at the first detection node $Nd_1$ and the voltage level of the first node $N_1$ are in positive correlation with each other. If the first detection node $Nd_1$ is connected to the output terminal of the first operational amplifier OP through a second path (Path B), the first detection signal $Sd_1$ measured at the first detection node $Nd_1$ and the voltage level of the first node $N_1$ are in negative correlation with each other.

Likewise, when the second constant current source circuit 125 is implemented with the constant current source circuit 1100, the drain electrode of first transistor $M_1$ is coupled to the second node $N_2$, and the detection node serves as the second detection node $Nd_2$. In case that the second detection node $Nd_2$ is coupled to the second node $N_2$ through the first path (Path A) to detect the second detection signal $Sd_2$, the second detection signal $Sd_2$ and the voltage level of the second node $N_2$ are in positive correlation with each other. On the contrary, in case that the second detection node $Nd_2$ is coupled to the output terminal of the first operational amplifier OP through the second path (Path B) to detect the second detection signal $Sd_2$, the second detection signal $Sd_2$ and the voltage level of the second node $N_2$ are in negative correlation with each other.

In the preferred embodiment of the present invention, the LED driving devices 105, 205, 305, 802, and 1100 are able to be integrated into an integrated circuit, and are able to modulate the output voltage of the regulator circuit and keep the output voltage at a low working voltage, without affecting the normal functions of the LED.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED driving device, comprising:

a first constant current source circuit, outputting a first constant current to a first node such that the first constant current flows into a first LED module disposed between a driving node and the first node, wherein the first constant current source circuit has a first detection node for generating a first detection signal in response to a voltage level of the first node; and a voltage control circuit, coupled to the first detection node for outputting a control signal in response to the first detection signal to a regulator circuit for controlling and adjusting the regulator circuit to output a driving voltage to the driving node; and a second constant current source circuit, outputting a second constant current to a second node such that the second constant current flows into a second LED module disposed between the driving node and the second node, wherein the second constant current source circuit has a second detection node for generating a second detection signal in response to a voltage level of the second node;

wherein the voltage control circuit is coupled to the second detection node for generating the control signal according to the first detection signal and the second detection signal to control the regulator circuit to adjust the driving voltage;

wherein the voltage control circuit comprises a detecting and comparing circuit for receiving and comparing the first detection signal and the second detection signal;

wherein when the voltage level of the first detection signal and the voltage level of the first node are in positive correlation with each other, the detecting and comparing circuit outputs a voltage difference between a working voltage and a lower one selected from the first detection signal and the second detection signal as a control signal for controlling the regulator circuit to increase the driving voltage; and wherein when the voltage level of the first detection signal and the voltage level of the first node are in negative correlation with each other, the detecting and comparing circuit outputs the voltage difference between the working voltage and a higher one selected from the first detection signal and the second detection signal as the control signal for controlling the regulator circuit to increase the driving voltage.

2. The LED driving device as claimed in claim 1, further comprising:

a first comparator, disposed between the first detection node and the voltage control circuit to compare the first detection signal with a predetermined voltage; and a second comparator, disposed between the second detection node and the voltage control circuit to compare the second detection signal with the predetermined voltage;

wherein according to the comparison results of the first comparator and the second comparator, the voltage control circuit outputs the control signal for controlling the regulator circuit to adjust the driving voltage.

3. The LED driving device as claimed in claim 2, wherein:

when the voltage level of the first detection signal and the voltage level of the first node are in positive correlation with each other and the comparison results show that the first detection signal or the second detection signal is lower than the predetermined voltage, the voltage control circuit directs the regulator circuit to increase the driving voltage;

when the voltage level of the first detection signal and the voltage level of the first node are in negative correlation with each other and the comparison results show that the first detection signal or the second detection signal is higher than the predetermined voltage, the voltage control circuit directs the regulator circuit to increase the driving voltage.

4. The LED driving device as claimed in claim 1, wherein the first constant current source circuit comprises:

a first transistor and a second transistor, connected in series and disposed between the first node and a reference ground, wherein a control terminal of the second transistor is coupled to a first voltage; and a first operational amplifier, having a first input terminal coupled to a second voltage, a second input terminal coupled to a connection node of the first transistor and the second transistor, and an output terminal coupled to a control terminal of the first transistor.

5. The LED driving device as claimed in claim 4, wherein the first detection node is the first node or the output terminal of the first operational amplifier.

6. The LED driving device as claimed in claim 5, wherein the first detection node is the first node, and when the voltage control circuit determines that the first detection signal is lower than a predetermined voltage, the voltage control circuit outputs the control signal for controlling the regulator circuit to increase the driving voltage.

7. The LED driving device as claimed in claim 5, wherein the first detection node is the output terminal of the first operational amplifier, and when the voltage control circuit determines that the first detection signal is higher than a predetermined voltage, the voltage control circuit outputs the control signal for controlling the regulator circuit to increase the driving voltage.

8. The LED driving device as claimed in claim 1, further comprising the regulator circuit.

* * * * *